US008911009B2

(12) United States Patent
Hoffman et al.

(10) Patent No.: US 8,911,009 B2
(45) Date of Patent: Dec. 16, 2014

(54) ROCKING-RECLINING SEATING UNIT

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 265 days.

(21) Appl. No.: 13/334,938

(22) Filed: Dec. 22, 2011

(65) Prior Publication Data

US 2012/0146364 A1 Jun. 14, 2012

Related U.S. Application Data

(63) Continuation-in-part of application No. 12/941,278, filed on Nov. 8, 2010.

(51) Int. Cl.
*A47C 1/031* (2006.01)
*A47C 1/0355* (2013.01)
*A47C 1/032* (2006.01)

(52) U.S. Cl.
CPC ..... *A47C 1/03266* (2013.01); *A47C 1/0355* (2013.01); *A47C 1/03272* (2013.01)
USPC ..... 297/85 L; 297/84; 297/75

(58) Field of Classification Search
CPC ..... A47C 1/0355; A47C 3/027
USPC ..... 297/84, 85 R, 85 L, 75, 259.2, DIG. 7
See application file for complete search history.

(56) References Cited

U.S. PATENT DOCUMENTS 3,550,952 A * 12/1970 Ferguson ..... 297/85 R
3,572,823 A * 3/1971 Hampton ..... 297/85 R
3,819,229 A * 6/1974 Rogers et al. ..... 297/84
3,869,169 A * 3/1975 Johnson et al. ..... 297/84
3,926,472 A * 12/1975 Evans ..... 297/88
4,025,113 A * 5/1977 Rogers, Jr. ..... 297/423.19
4,185,870 A * 1/1980 Johnson ..... 297/84
4,504,090 A 3/1985 Goldman
4,662,673 A 5/1987 Crum
4,707,025 A 11/1987 Rogers, Jr.
RE33,704 E * 10/1991 Rogers, Jr. ..... 297/85 R
5,120,107 A * 6/1992 Rogers, Jr. ..... 297/68
5,419,611 A * 5/1995 Cook ..... 297/85 L
5,435,621 A * 7/1995 Komorowski et al. ..... 297/84
5,570,930 A * 11/1996 LaPointe et al. ..... 297/342
5,738,409 A 4/1998 Bursik
5,876,094 A * 3/1999 Hoffman ..... 297/259.2
6,033,020 A 3/2000 Ito (Continued)

*Primary Examiner* — David R Dunn
*Assistant Examiner* — Alexander Harrison
(74) *Attorney, Agent, or Firm* — Myers Bigel Sibley & Sajovec, P.A.

(57) ABSTRACT

A reclining seating unit includes: a base; a rocker assembly fixed to the base; an arm frame fixed to the rocker assembly, wherein the rocker assembly is configured such that the arm frame experiences rocking motion relative to the base; a generally horizontally-disposed seat; a generally upright backrest positioned rearwardly of the seat; a footrest unit; and a reclining mechanism that interconnects and controls movement of the seat and the backrest relative to the arm frame between an upright position and a reclined position. The footrest unit comprises at least one footrest and a footrest mechanism that interconnects the footrest with the seat. And is decoupled from the reclining mechanism. When the backrest moves between the upright and reclined positions, the footrest unit moves relative to the arm frame in concert with the seat. In the reclined position, the rocking mechanism prevents the arm frame from rocking.

19 Claims, 15 Drawing Sheets

(56) References Cited

U.S. PATENT DOCUMENTS

| | | | | |
|---|---|---|---|---|
| 6,120,095 | A * | 9/2000 | Rogers | 297/273 |
| 6,557,942 | B1 * | 5/2003 | Shieh | 297/440.15 |
| 6,634,706 | B2 | 10/2003 | May | |
| 6,659,556 | B2 | 12/2003 | Pellerin | |
| 6,733,071 | B2 | 5/2004 | Guillot et al. | |
| 6,769,734 | B2 * | 8/2004 | Tacker | 297/61 |
| 6,840,575 | B2 | 1/2005 | Hesse | |
| 6,945,599 | B2 | 9/2005 | May | |
| 7,021,711 | B1 | 4/2006 | Hoffman et al. | |
| 7,281,764 | B2 | 10/2007 | Thole | |
| 7,575,279 | B2 | 8/2009 | Robertson | |
| 7,628,452 | B2 | 12/2009 | Du et al. | |
| 8,113,574 | B2 * | 2/2012 | Hoffman et al. | 297/85 M |
| 8,590,964 | B2 * | 11/2013 | Murphy et al. | 297/85 R |
| 2003/0057743 | A1 * | 3/2003 | May | 297/84 |
| 2004/0160101 | A1 * | 8/2004 | Thole | 297/300.4 |
| 2006/0061163 | A1 * | 3/2006 | Wang et al. | 297/259.2 |
| 2006/0103179 | A1 * | 5/2006 | Pine | 297/85 |
| 2006/0273631 | A1 * | 12/2006 | White et al. | 297/85 |
| 2007/0205645 | A1 * | 9/2007 | Donovan et al. | 297/259.2 |
| 2008/0012396 | A1 * | 1/2008 | Hoffman et al. | 297/85 |
| 2009/0243368 | A1 * | 10/2009 | LaPointe | 297/85 R |
| 2011/0018331 | A1 * | 1/2011 | Murphy et al. | 297/85 R |
| 2011/0233972 | A1 * | 9/2011 | Weicek | 297/84 |
| 2012/0112519 | A1 * | 5/2012 | Murphy et al. | 297/85 M |
| 2012/0146364 | A1 | 6/2012 | Hoffman et al. | |
| 2012/0248831 | A1 * | 10/2012 | Garland | 297/84 |
| 2013/0257111 | A1 * | 10/2013 | Wiecek | 297/84 |

* cited by examiner

312

ROCKING-RECLINING SEATING UNIT

RELATED APPLICATION

This application is a continuation-in-part of and claims the benefit of and priority from U.S. patent application Ser. No. 12/941,278, filed Nov. 8, 2010, the disclosure of which is hereby incorporated herein in its entirety.

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "rocker-recliner," which can, when in the upright position, rock with a forward and rearward motion similar to that of a traditional rocking chair. A typical rocker recliner, one of which is illustrated in U.S. Pat. No. 4,519,647 to Rogers, includes an arcuate rocker cam that is attached with the lower portion of each mechanism, with the lower convex surface of the rocker cam contacting a level bearing surface of the base. Also, a spring assembly is mounted to the base of the chair and to each rocker cam. Each spring assembly includes two quite stiff, vertically-oriented helical springs attached to mounting brackets that are in turn fixed to the base and to the rocker cam. When the chair is in its upright position and is unoccupied, the seat, backrest and reclining mechanisms reside above the base, the rocker springs are deflected only along their longitudinal axes, and the rocker cams rest on a level portion of the base. When an occupant sits on the chair and applies a forwardly- or rearwardly-directed force to the seat or backrest, the seat and backrest move relative to the base. The path of movement is defined by the convex shape of the rocker cams as they rock on the level bearing surface of the base, with the result that the seat and backrest simulate the rocking motion of a rocking chair. During the rocking movement, the rocker springs deflect such that their top portions bend away from their longitudinal axes as the chair rocks forward and back. The deflection in the springs urges the springs (and, in turn, the seat and backrest) to return to their original positions as the chair returns to and through the upright position. In this manner, the chair is capable of providing a controlled rocking motion when in the upright position.

Although they are already popular seating units, it may be desirable to provide additional functionality to rocker-recliners.

SUMMARY OF THE INVENTION

As a first aspect, embodiments of the present invention are directed to a reclining seating unit. The reclining seating unit comprises: a base; a rocker assembly fixed to the base; an arm frame fixed to the rocker assembly, wherein the rocker assembly is configured such that the arm frame experiences rocking motion relative to the base; a generally horizontally-disposed seat; a generally upright backrest positioned rearwardly of the seat; a footrest unit; and a reclining mechanism that interconnects and controls movement of the seat and the backrest relative to the arm frame between an upright position and a reclined position. In the upright position, the backrest is generally upright and positioned above the arm frame, and the seat has a first rearward position relative to the arm frame. In the reclined position, the backrest is reclined relative to the underlying surface as compared to its disposition in the upright position and the seat has a second forward position relative to the arm frame that is forward of the first rearward position. The footrest unit comprises at least one footrest and a footrest mechanism that interconnects the footrest with the seat. The footrest mechanism is configured to move the footrest between a retracted position, in which the footrest is positioned beneath the seat, and an extended position, in which the footrest is generally horizontally disposed in front of the seat; the footrest mechanism being decoupled from the reclining mechanism. When the backrest moves between the upright and reclined positions, the footrest unit moves relative to the arm frame in concert with the seat. In the reclined position, the rocking mechanism is configured such that the arm frame is prevented from rocking.

As a second aspect, embodiments of the present invention are directed to a reclining seating unit comprising: a base; a rocker assembly fixed to the base; an arm frame fixed to the rocker assembly; a generally horizontally-disposed seat; a generally upright backrest positioned rearwardly of the seat; and a reclining mechanism that interconnects and controls movement of the seat and the backrest relative to the arm frame between an upright position and a reclined position. In the upright position, the backrest is generally upright and positioned above the arm frame, and the seat has a first rearward position relative to the arm frame, and in the reclined position, the backrest is reclined relative to the underlying surface as compared to its disposition in the upright position. The rocker assembly is configured such that the arm frame experiences rocking motion relative to the base. The rocker assembly comprises: a mounting bracket fixed relative to the base; a rocking link fixed relative to the arm frame and pivotally attached to the mounting bracket at a first pivot, wherein the first pivot is positioned near a frontmost portion of the seat; and a spring unit attached to the mounting bracket and to the rocking link that is configured to dampen relative rocking motion of the arm frame and the base. In the reclined position, the rocking mechanism is configured such that the arm frame is prevented from rocking.

DETAILED DESCRIPTION OF EMBODIMENTS OF THE INVENTION

Figure 1:
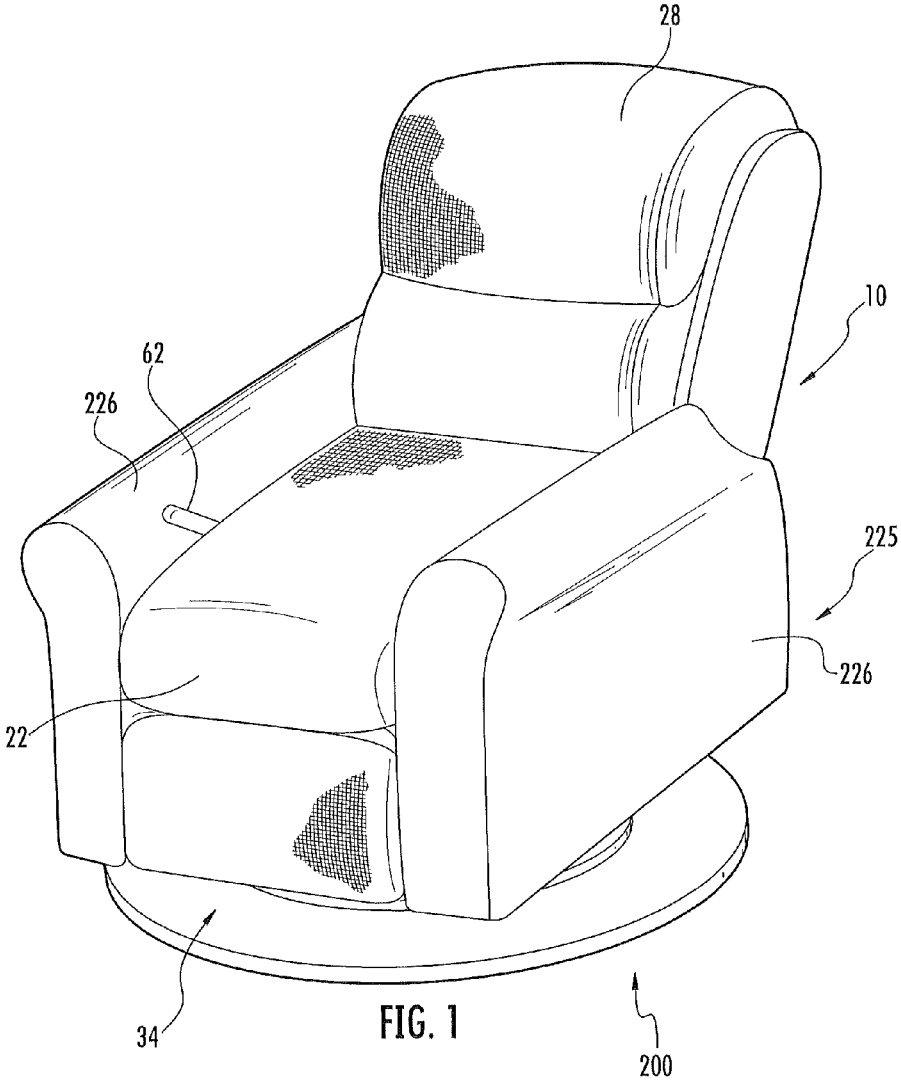
FIG. 1 is a perspective view of a rocker-recliner chair according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the drawings, a chair, designated broadly at 10, is illustrated in FIGS. 1-6. The chair 10 includes a base 200, an arm frame 225, a seat 22, a backrest 28, and a footrest unit 34. These components identified above are described in greater detail below. As used herein to describe the relative positions of components, the terms "lateral", "outward" and derivatives thereof indicate the directions defined by a vector beginning at a vertical plane P (shown in FIG. 5) that bisects the chair 10 normal to the seat 22 and the backrest 28 and extending normal thereto (i.e., from the center of the chair 10 toward the arms). Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

The base 250 includes a circular, two-level foundation 252. A swivel unit 253 includes a sleeve 254 within which is rotatably mounted a spindle 256. A plate 258 is fixed to the upper end of the spindle 256. Cross-members 260*a*, 260*b* are mounted to the underside of the plate 258.

A rocker assembly 262 includes a mounting bracket 264 fixed at each end of the cross-members 260*a*, 260*b*. A cross-member 266 spans the mounting brackets 264. A rocking link 276 is mounted at a pivot 280 to each mounting bracket 264. The pivot 280 is positioned well forward of the spindle 256 of the swivel unit 253, typically between about 3 and 7.5 inches from the front of the seat 22. A spring base 278 spans the front portions of the rocking links 276, and a cross-member 284 spans the rear portions of the rocking links 276. A cross member 284 is fixed to the cross-member 282 and terminates in a mounting panel 286. A cross-member 288 is mounted to lower forward portions of the rocking links 276. A pin 264*a* mounted to the mounting bracket 264 extends through an arcuate slot 276*a* in the rocking link 276. A spring unit 268 includes a helical spring 270 and a spring rod 272. The spring rod 272, which passes through the coils of the spring 270, is mounted at one end to a cap 275, which is threaded onto the spring rod 272, and at its other end to the spring base 278 at a pivot 274.

Notably, the rocker assembly 262 is relatively short in height, which can enable it to be used with multiple chair styles. In some embodiments, the height of the rocker assembly 268, measured from its lowermost portion (in this case the lower end of the end cap 275) to its uppermost portion (in this instance the uppermost end of the mounting bracket 264) is between about 3.5 and 5.5 inches.

The arm frame 225 includes two arms 226, only one of which will be described in detail herein. The arms 226 are spanned by a cross-member 228, and by the cross-members 282, 288, which are mounted to the inner surfaces of the arms 226 via mounting panels 286, 290 respectively.

Referring again to FIGS. 1 and 6, the seat 22 includes a seat frame 24 that is generally horizontally disposed between the arms 16, with a slight incline (typically between about 1 and 12 degrees) from rear to front. The seat frame 24 is formed by two cross-members 26*a*, 26*b* and two seat mounting brackets 50. The seat 22 is mounted to the arm frame 225 via a pair of reclining mechanisms 40, which are described in detail below.

Figure 5:
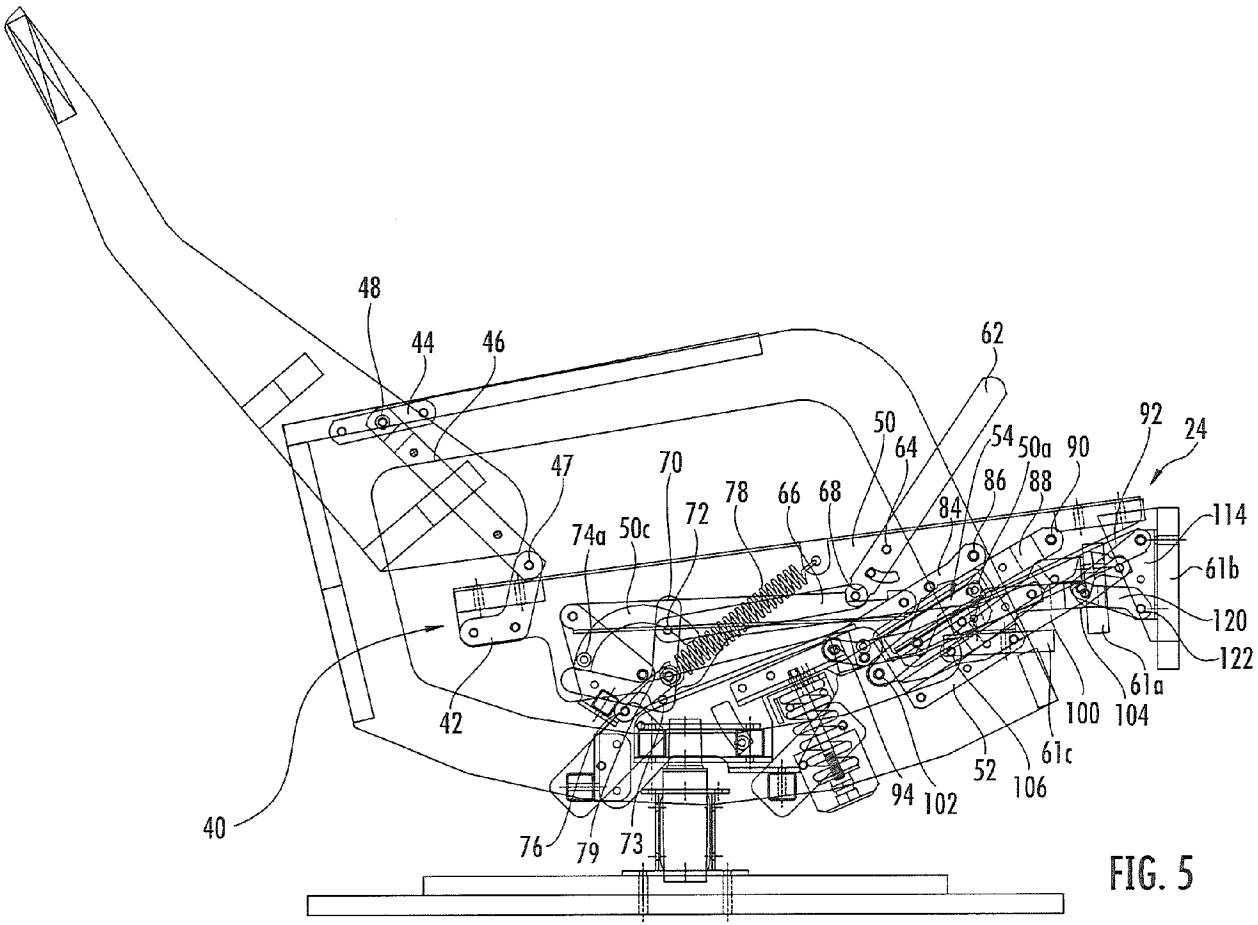
FIG. 5 is a side section view of the chair of FIG. 1 with the backrest in its reclined position and the footrest in its retracted position.
Figure 6:
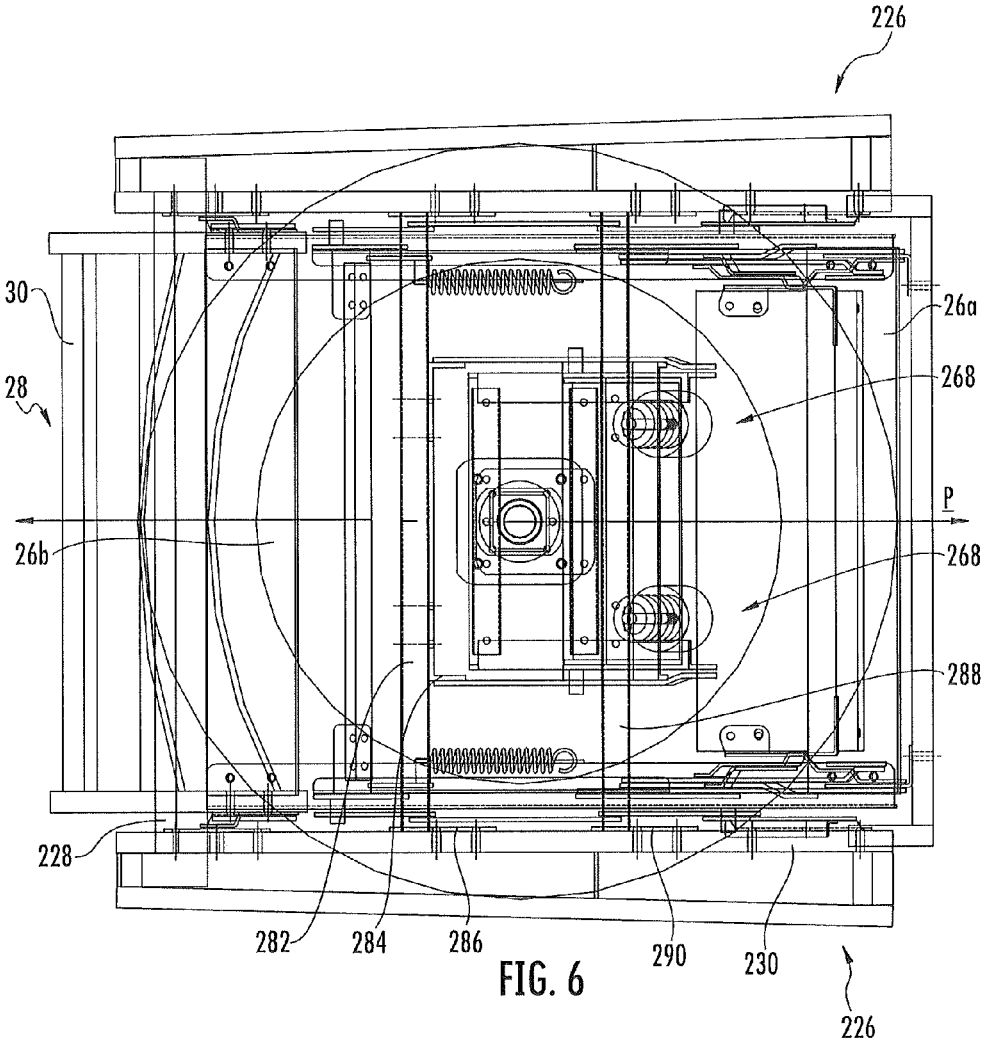
FIG. 6 is a top cutaway view of the frame of the chair of FIG. 1.

The backrest 28 is disposed to be generally upright (with a typical angle $\alpha$ of between about 55 and 80 degrees to horizontal—see FIG. 1) above the rear portion of the base 200. The backrest 28 includes a frame 30 that is attached to the reclining mechanism 40 (FIG. 5).

The reclining mechanisms 40 mount the seat 22 and the backrest 28 to the arm frame 225 and move the backrest 28 between an upright position (FIGS. 1, 2 and 3), in which the backrest 28 is generally upright and positioned above the rear portion of the seat 22, and a reclined position (FIGS. 2 and 4), in which the backrest 28 is reclined relative to the upright position. The reclining mechanisms 40 are mirror images of one another about the plane P; as such, only one reclining mechanism 40 is described herein, with the understanding that this discussion is equally applicable to the reclining mechanism on the opposite side of the chair 10. Also, the reclining mechanism 40 will be described first with respect to FIGS. 1 and 3, wherein the backrest 28 is in the upright position; a description of its movement to the reclined position (FIGS. 2 and 4) will then follow.

Figure 3:
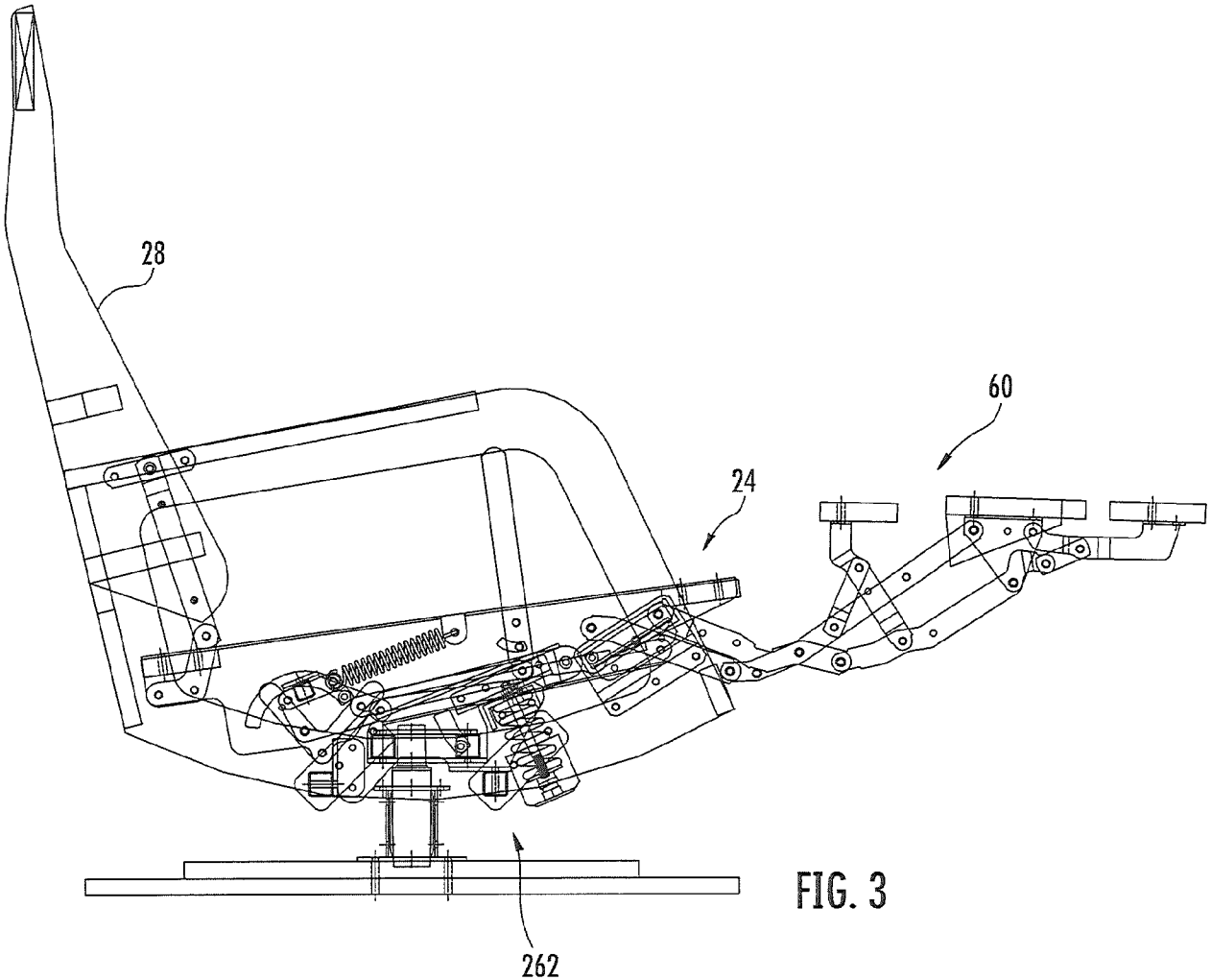
FIG. 3 is a side section view of the chair of FIG. 1 with the backrest in its upright position and the footrest in its extended position.

As can be seen in FIGS. 1 and 3, the reclining mechanism 40 includes an L-shaped rear seat mounting bracket 42 that is mounted to the rear outer edge of the seat panel 24 and extends upwardly therefrom. A backrest mounting bracket 44 is fixed to the inner surface of the inner panel 230 of the arm frame 225. A coupling link 46 is fixed to the frame 30 of the backrest 28. The coupling link 46 is pivotally attached to the backrest mounting bracket 44 at a pivot 48 and extends downwardly and slightly forwardly therefrom to attach to the rear seat mounting bracket 42 at a pivot 47.

Still referring to FIG. 3, the seat mounting bracket 50 includes a pin 50*a* on its outboard surface. A frame mounting bracket 52 is mounted to the inner surface of the arm 226. The frame mounting bracket 52 includes a slot 54 that extends upwardly and forwardly and receives the pin 50*a* of the seat mounting bracket 50. In the upright position shown in FIG. 3, the pin 50*a* is located at the rear end of the slot 54 and prevents rearward movement of the seat 22 relative to the frame 12; gravity prevents forward movement of the seat 22 and backrest 28 relative to the arm frame 225.

Figure 2:
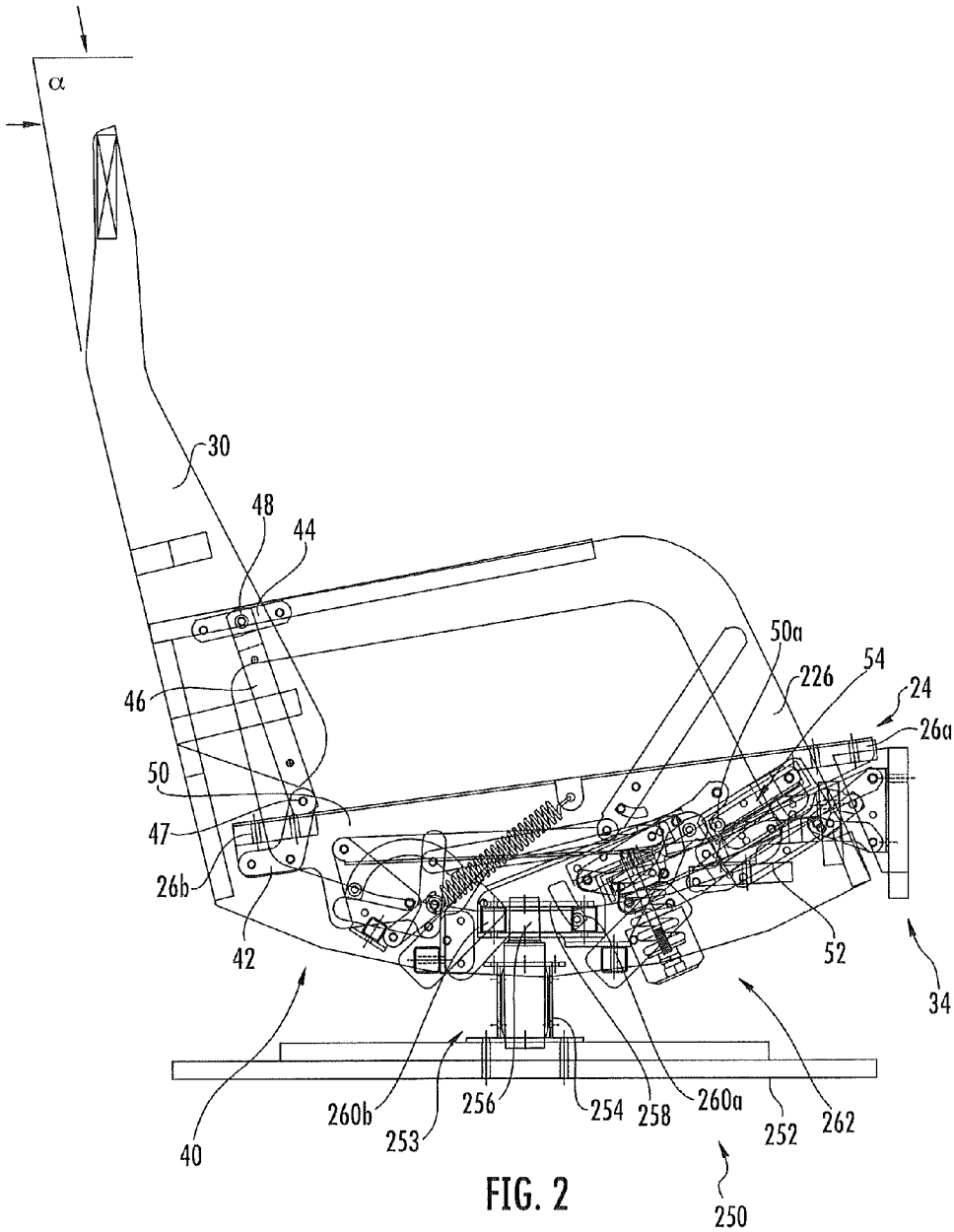
FIG. 2 is a side section view of the chair of FIG. 1 with the backrest in its upright position and the footrest in its retracted position.
Figure 4:
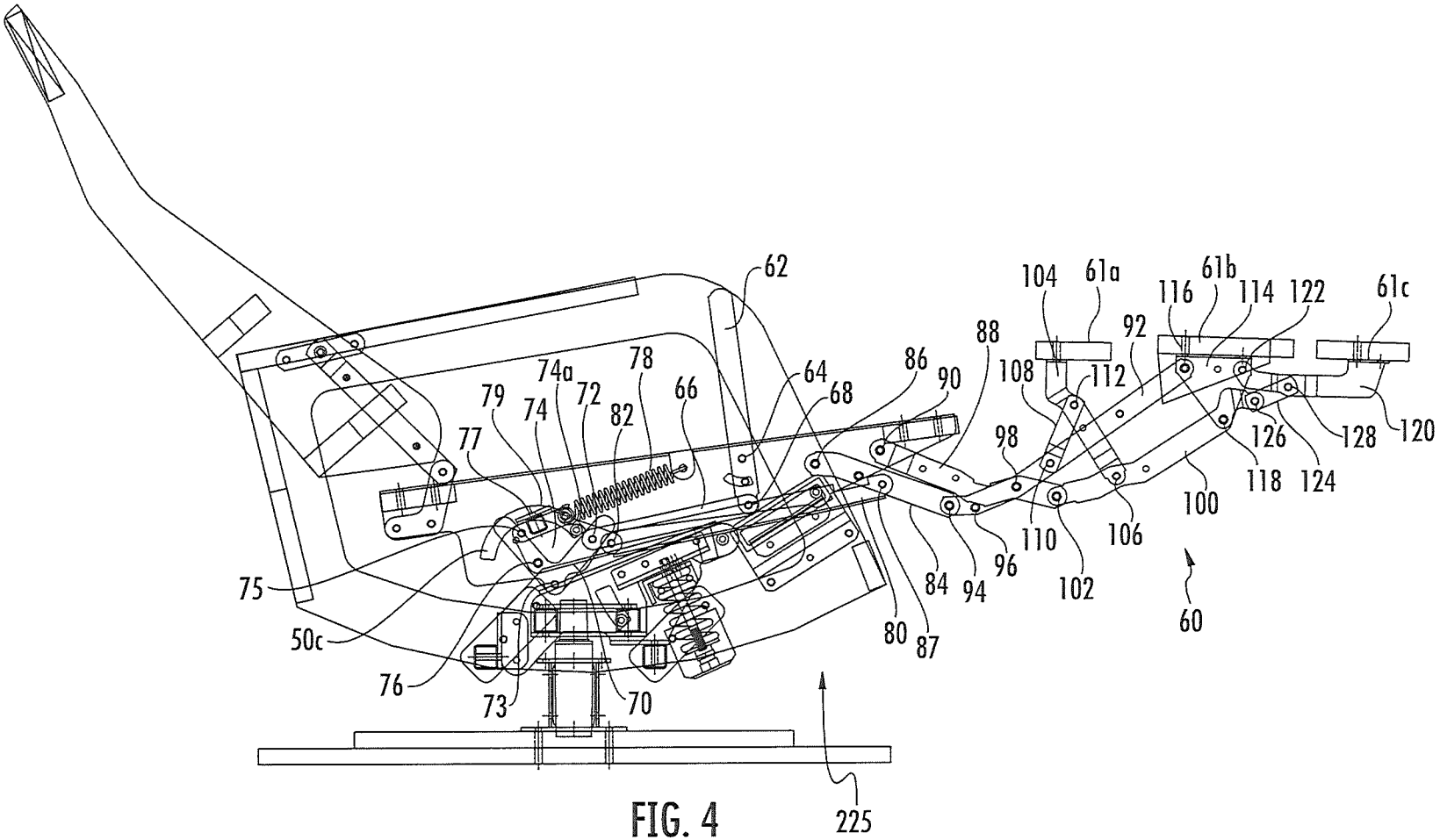
FIG. 4 is a side section view of the chair of FIG. 1 with the backrest in its reclined position and the footrest in its extended position.

In operation, the backrest 28 may be moved from the upright position of FIGS. 1, 2 and 3 to the reclined position of FIGS. 4 and 5 through a rearwardly-directed force applied to the backrest 28 (typically via an occupant of the chair 10 pushing rearwardly on the arms 226, such that the occupant's back is pressed into the upper end of the backrest 28). Such a force causes the backrest 28, and in turn the coupling link 46, to rotate (counterclockwise from the vantage point of FIGS. 2 and 3) about the pivot 48. The lower, forward end of the backrest 28 rises slightly and moves forwardly, and in doing so drives the rear seat mounting bracket 42 and, in turn, the seat 22 forwardly. The motion of the front end of the seat 22 follows the movement of the pin 50*a* as it moves forwardly in the slot 54. Motion ceases when the pin 50*a* reaches the forward end of the slot 54. Typically, the seat 22 moves forward between about 2.5 and 6 inches in moving from the upright position to the reclined position.

Notably, the backrest 28 and footrest unit 34 are decoupled from each other, such that the backrest 28 is able to move to the reclined position independent of the position (i.e., retracted or extended) of the footrest unit 34. However, the entire footrest unit 34 moves in concert with the seat 22 in either position.

The backrest 28 is maintained in the reclined position by the contact of the pin 50*a* with the front end of the slot 54. The backrest 28 can be returned to the upright position of FIGS. 1, 2 and 3 by applying a rearwardly-directed force to the lower portion of the backrest 28 (typically by the occupant pressing his back against the lower portion of the backrest 28).

Turning now to FIG. 4, the footrest unit has two footrest mechanisms 60 that attach extendable footrest panels 61*a*, 61*b*, 61*c* to the arm frame 225. The footrest mechanisms 60 move the footrest panels 61*a*, 61*b*, 61*c* between retracted positions below a front portion of the seat 22 to extended positions in front of the seat 22. Like the reclining mechanism 40, the footrest mechanisms 60 are mirror images of each other about the plane P; consequently, only one of the footrest mechanisms 60 will be described herein, with the understanding that such description is applicable to the other footrest mechanism 60. For the sake of clarity, the footrest mechanism 60 will be described initially with respect to FIG. 4, in which the backrest 28 is in its reclined position and the footrest unit 34 is in its extended position.

The footrest mechanism 60 includes an actuating handle 62 that is attached to the seat mounting bracket 50 at a pivot 64. The graspable portion of the handle 62 extends generally upwardly therefrom and is located inboard of the adjacent arm 226. The lower portion of the handle 62 is pivotally attached to a drawing link 66 at a pivot 68. The drawing link 66 extends rearwardly from the pivot 68 to terminate in a pivot 72 with a V-shaped crank 70. The crank 70 extends downwardly and rearwardly from the pivot 72 to a pivot 73 with the seat mounting bracket 50, then rearwardly and upwardly therefrom. A drive plate 74 is pivotally attached to the seat mounting plate 50 at a pivot 76; a cross-member 77 spans the drive plates 74 of the footrest mechanisms 60 on each side of the chair 10. Also, a pin 74*a* is mounted to the drive plate 74 and extends into an arcuate slot 50*c* in the seat mounting bracket 50. A spring link 79 is attached to the drive plate 74 at a pivot 75. A spring 78 is attached between a forward portion of the spring link 79 and the seat mounting bracket 50; the spring 78 is in tension.

A footrest drive link 80 is attached to the forward end of the drive plate 74 at a pivot 82 and extends generally forwardly and slightly upwardly therefrom. A lower footrest swing link 84 is attached to the seat mounting bracket 50 at a pivot 86 and extends generally forwardly therefrom, and an upper footrest swing link 88 is attached to the seat mounting bracket 50 at a pivot 90 that is positioned slightly upwardly and forwardly from the pivot 86 and extends generally forwardly therefrom. The footrest drive link 80 is attached to the lower footrest swing link 84 at a pivot 87. An upper footrest extension link 92 is attached to the forward end of the lower footrest swing link 84 at a pivot 94 and extends forwardly and upwardly therefrom. Similarly, a lower footrest extension link 100 is attached to the upper footrest swing link 88 at a pivot 102 and extends forwardly and upwardly therefrom. The upper footrest extension link 92 is also pivotally attached to the upper footrest swing link at a pivot 98. The upper footrest extension link 92 also includes a pin 96 between the pivots 94 and 98.

The footrest 61*a* is attached to the footrest mechanism 60 via a rear footrest link 104 that is pivotally attached to the lower footrest extension link 100 at a pivot 106 and extends upwardly and rearwardly therefrom to meet the footrest 61*a*. A brace 108 is attached to the rear footrest link 104 at a pivot 112 and to the upper footrest extension link 92 at a pivot 110. The footrest 61*b* is mounted on a middle footrest bracket 114, which is attached to the upper and lower footrest extension links 92, 100 at pivots 116, 118 respectively. The footrest 61*c* is mounted to a front footrest link 120, which is attached to the middle footrest bracket 114 at a pivot 122 and extends forwardly therefrom to meet the footrest 61*c*. A brace 124 is attached to the front end of the lower footrest extension link 100 at a pivot 126 and to the front footrest link 120 at a pivot 128.

The footrests 61*a*, 61*b*, 61*c* of the chair 10 can be moved between their retracted positions (FIGS. 1 and 2) and their extended positions (FIGS. 3 and 4) through movement of the handle 62. Turning first to FIG. 1, it can be seen that the handle 62 extends upwardly and forwardly from the pivot 64. The drawing link 66 is generally horizontal and extends rearwardly from the pivot 68, and the crank 70 extends downwardly from the pivot 72 to the pivot 73, then rearwardly to a position below the pin 74*a*, which is located in the rear end of the slot 50*c*. The drive plate 74 is oriented such that the pivot 75 is below the pivot 73. The spring link 79 extends upwardly and forwardly from the pivot 75, with the result that the pivot 75 and the spring 78 create an "over-center" condition. The footrest drive link 80 extends generally forwardly from the pivot 82. The upper and lower footrest swing links 88, 84 extend downwardly and rearwardly from their respective pivots 90, 86 with the seat mounting bracket 50, and the upper and lower footrest extension links 92, 100 extend upwardly and forwardly from, respectively, pivots 94, 102. The rear footrest link 104 extends upwardly and forwardly from the pivot 106, such that the footrest 61*a* is generally vertically disposed underneath the forward portion of the seat panel 24. The middle footrest bracket 114 is disposed such that the footrest 61*b* is vertically disposed and is substantially flush with the front panels 20*a* of the wings 20. The front footrest bracket 120 is extends rearwardly from the pivot 122, such that the footrest 61*c* is positioned below the forward portion of the seat panel 24 and faces downwardly. The footrest mechanism 60 is maintained in the retracted position by an "over-center" condition defined by the ends of the spring 78 and the pivot 76, wherein the spring 78 biases the footrest unit toward the retracted position.

To move the footrests 61*a*, 61*b*, 61*c* from their retracted positions shown in FIGS. 1 and 2 to their extended positions shown in FIGS. 3 and 4, an occupant of the chair 10 applies a rearwardly-directed force to the handle 62, which causes the handle 62 to rotate (counterclockwise from the vantage point of FIG. 1) about the pivot 64. This action pulls the drawing link 66 forward, which in turn draws the forward leg of the crank 70 forward and rotates the crank 70 clockwise about the pivot 73. As the crank 70 rotates, its rear leg strikes the pin 74*a* and forces it forwardly in the slot 50*c*, which in turn forces the drive plate 74 to rotate clockwise about the pivot 76. This motion is encouraged by the tension in the spring 78 after the drive plate 74 rotates sufficiently that the over-center condition between the ends of the spring 78 and the pivot 75 no longer exists. Rotation of the drive plate 74 drives the footrest drive link 80 forward. Forward motion of the footrest drive link 80 rotates the lower footrest swing link 84 counterclockwise about the pivot 86, which action forces the upper footrest extension link 92 forward. The forward movement of the upper footrest extension link 92 rotates the upper footrest swing link 88 counterclockwise, which in turn drives the lower footrest extension link 100 forward.

The forward movement of the upper and lower footrest extension links 92, 100 unfolds the footrests 61*a*, 61*b*, 61*c*. More specifically, as the upper and lower footrest links 92, 100 move forwardly, the brace 108 rotates counterclockwise about the pivot 110, which action rotates the rear footrest link 104 counterclockwise about the pivot 106. This rotation raises the footrest 61*a* and rotates it counterclockwise to a generally horizontal disposition in front of the seat 22. The movement of the upper and lower footrest extension links 92, 100 also causes the middle footrest bracket 114 and the footrest 61*b* to rotate counterclockwise to a generally horizontal disposition in front of the footrest 61*a*. Finally, the movement of the upper and lower footrest extension links 92, 100 forces the brace 124 forward and rotates it counterclockwise about the pivot 126; this rotation causes the front footrest link 120 to rotate counterclockwise about the pivot 122 to an inverted position, such that the footrest 61*c* is generally horizontally disposed and positioned in front of the footrest 61*b*. Movement of the footrest mechanism 60 ceases when a pin 74*b* on the drive plate 74 strikes the rear edge of the seat mounting plate 50 and the pin 96 contacts the lower edge of the upper footrest swing link 88.

The footrests 61*a*, 61*b*, 61*c* can be moved back to the retracted position by the occupant pushing the handle 62 forward. As the handle 62 rotates clockwise about the pivot 64, the lower portion of the handle 62 forces the drawing link 66 rearwardly, which in turn rotates the crank 70 counterclockwise about the pivot 73. This movement, combined with the weight of the occupant's legs on the footrests 61*a*, 61*b*, 61*c*, overcomes the "over-center" condition created by the pivots 76, 82, 87, which releases the footrests 61*a*, 61*b*, 61*c* and allows them to collapse into their retracted positions (FIGS. 1 and 2).

Figure 7:
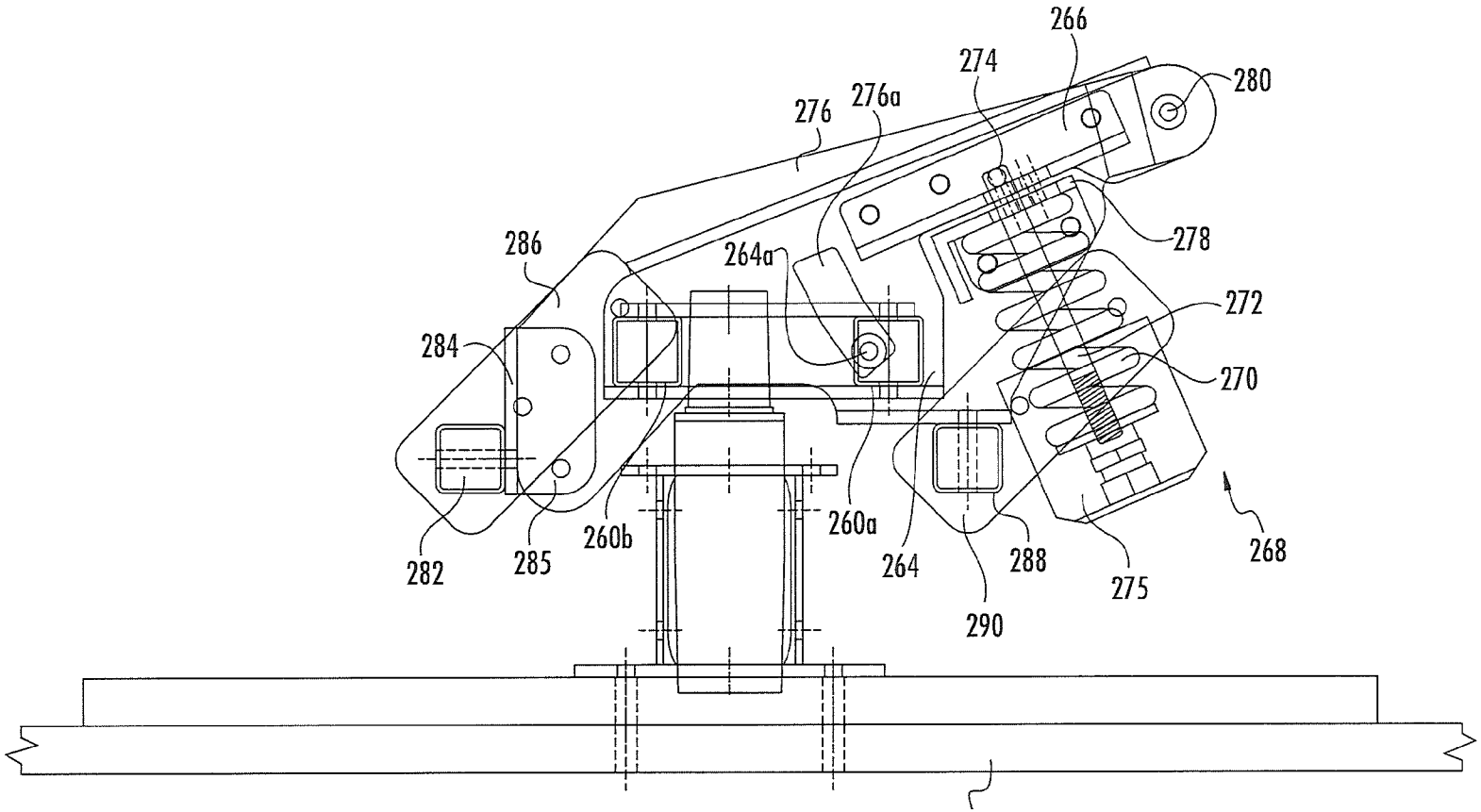
FIG. 7 is a side view of the base and rocking assembly of the chair of FIG. 1 with the rocking assembly rocked forwardly.
Figure 8:
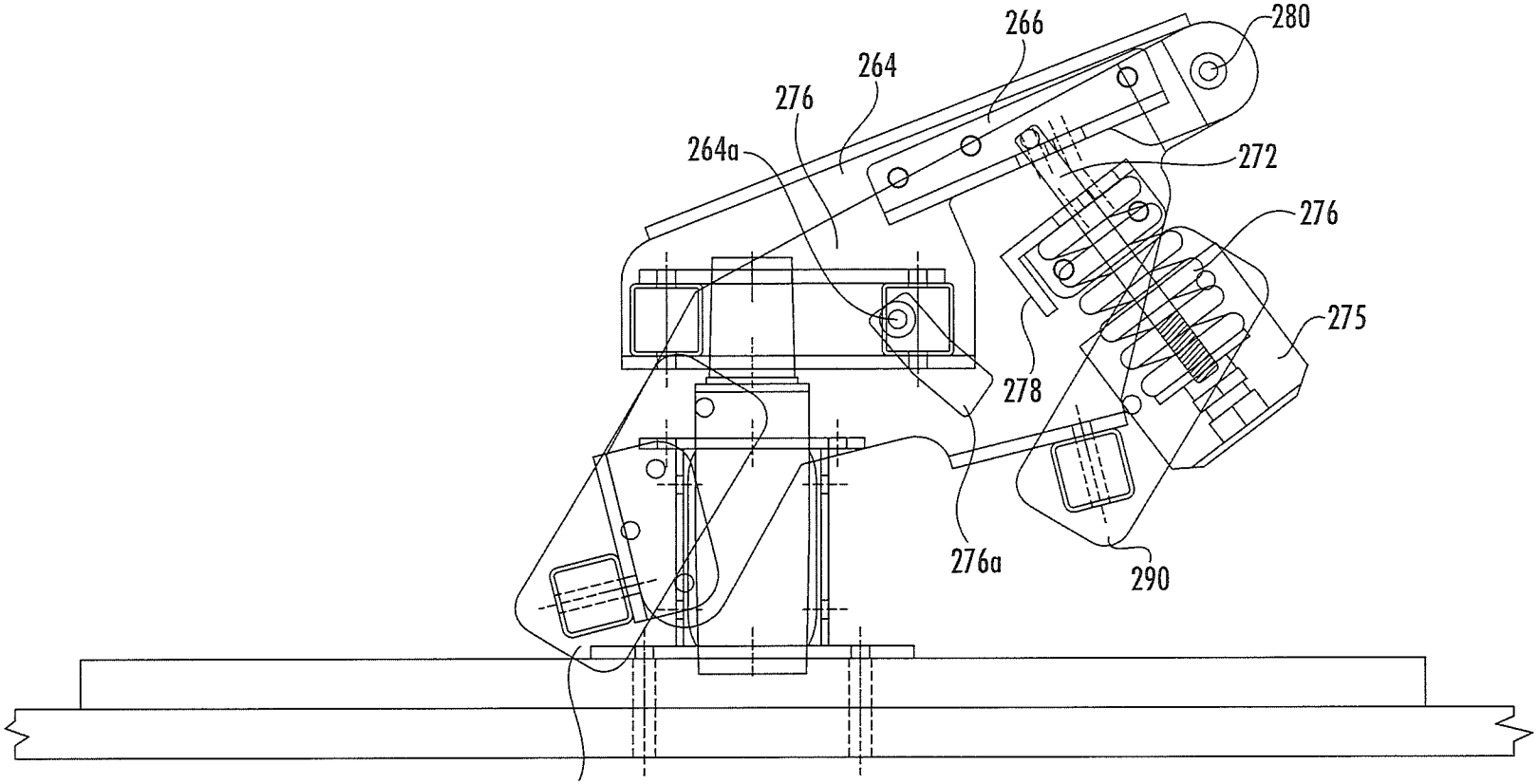
FIG. 8 is a side view of the base and rocking assembly of FIG. 7 with the rocking assembly rocked rearwardly.

The chair 10 is also free to rock in any of the positions of the backrest 28 and the footrests 61*a*, 61*b*, 61*c*. As can be seen in FIGS. 7 and 8, the arm frame 225 is fixed to the mounting panels 286, 290, the cross-members 282, 288 and the rocking links 276. The base 250 is fixed to the mounting brackets 264.

Because the rocking links 276 are able to pivot relative to the mounting brackets 264 about the pivot 280, the arm frame 225 is able to rock relative to the base 12. Rocking motion is dampened by the spring 270. As shown in FIG. 7, the spring 270 is confined between the cap 275 and the spring base panel 278. When the chair 10 is unoccupied, or when the occupant is leaning or rocking forward, the spring 270 biases the spring base panel 278, and in turn the rocking links 276, upwardly, such that the arm frame 225 and seat 24 are "rocked" forwardly, with the rear of the seat 24 in its most elevated position. In this position (shown in FIG. 7), the rocking link 276 is oriented such that the pin 264*a* is located in the bottom end of the slot 276*a*.

As the occupant rocks the chair 10 rearwardly, the rocking links 276 pivot counterclockwise relative to the mounting brackets 264 about the pivot 280. When this occurs, the spring base panel 278 is lowered and compresses the spring 270 against the cap 275. The distance between the cap 275 and the cross-member 266 is essentially constant due to the presence of the rod 272, although the rod 272 is free to pivot about the pivot 274. Compression of the spring 270 dampens the rocking motion and urges the chair 10 to return to its forward position. The maximum stroke of the rocking motion is controlled by the pin 264*a* on the mounting bracket 264 reaching the upper end of the slot 276*a* in the rocking link 276.

The foregoing demonstrates that the chair 10 provides great flexibility to the occupant: he can recline the backrest with the footrest extended or retracted, or allow the backrest to remain upright with the footrest retracted or extended. In any of these positions, the occupant is free to rock while occupying the chair 10. Because the seat 22 moves forwardly relative to the arm frame 225 when the backrest 28 reclines; the center of gravity of the chair 10 and the occupant moves forward relative to the base 12, such that the chair 10 resists tipping over backward when the backrest 28 is reclined with an occupant present.

In addition, the position of the pivot 280 between the rocking link 276 and the mounting bracket 264 (i.e., considerably forward of the spindle 256 of the swivel unit 253) can provide a somewhat different, and in many cases more pleasant, rocking motion to the chair 10. In a conventional rocker-recliner that employs cams that rock relative to the floor and springs that control/dampen the rocking motion, the pivot point for rocking motion of the chair is much farther from the front of the chair, which results in a rocking motion that lowers the rear of the seat as the occupant rocks rearwardly and lowers the front of the seat as the occupant rocks forwardly. This type of motion can be somewhat uncomfortable if the occupant has his feet on the floor, and in some instances the occupant can experience the uncomfortable feeling of being "flung" forwardly. In contrast, the motion of the chair 10 is primarily limited to the rear portion of the seat 22 lowering and rising during the rocking motion; because the pivot 280 is positioned relatively near the front of the seat 22 (typically between about 3 and 7.5 inches), the forward portion of the seat drops very little, if at all, during the rocking motion, and considerably less than the rearmost portion of the seat 22. Consequently, the motion can be more comfortable for an occupant who is sitting with his feet on the floor, and there is little to no sensation of being "flung" forwardly. In this sense, the "rocking" motion is somewhat like that provided by an office chair.

It should also be noted that the dampening influence of the spring unit 268 can be adjusted. Because the end cap 275 is threaded on the rod 272, rotation of the end cap 275 relative to the rod 272 moves the position of the end cap 275 relative to the spring base 278, thereby adjusting the degree of compression in the spring 270. As such, dampening effect of the spring unit 268 on the rocking motion of the chair 10 can be increased by tightening the end cap 275 and decreased by loosening the end cap 275.

Another embodiment of a chair of the present invention is illustrated in FIGS. 9-15 and designated broadly at 300. Rather than relying on handle actuation like the chair of FIGS. 1-8, the chair 300 is actuated via the occupant pushing on the arms of the chair 300.

The chair 300 includes a base 312 that rests on an underlying surface, a rocker assembly 313, a frame 314, a seat 316, a backrest 318, and rear, main, and front ottomans 320*a*, 320*b*, 320*c*. These structures are interconnected with a pair of reclining mechanisms 321 (see FIG. 11). These components are discussed in greater detail below.

Figure 15:
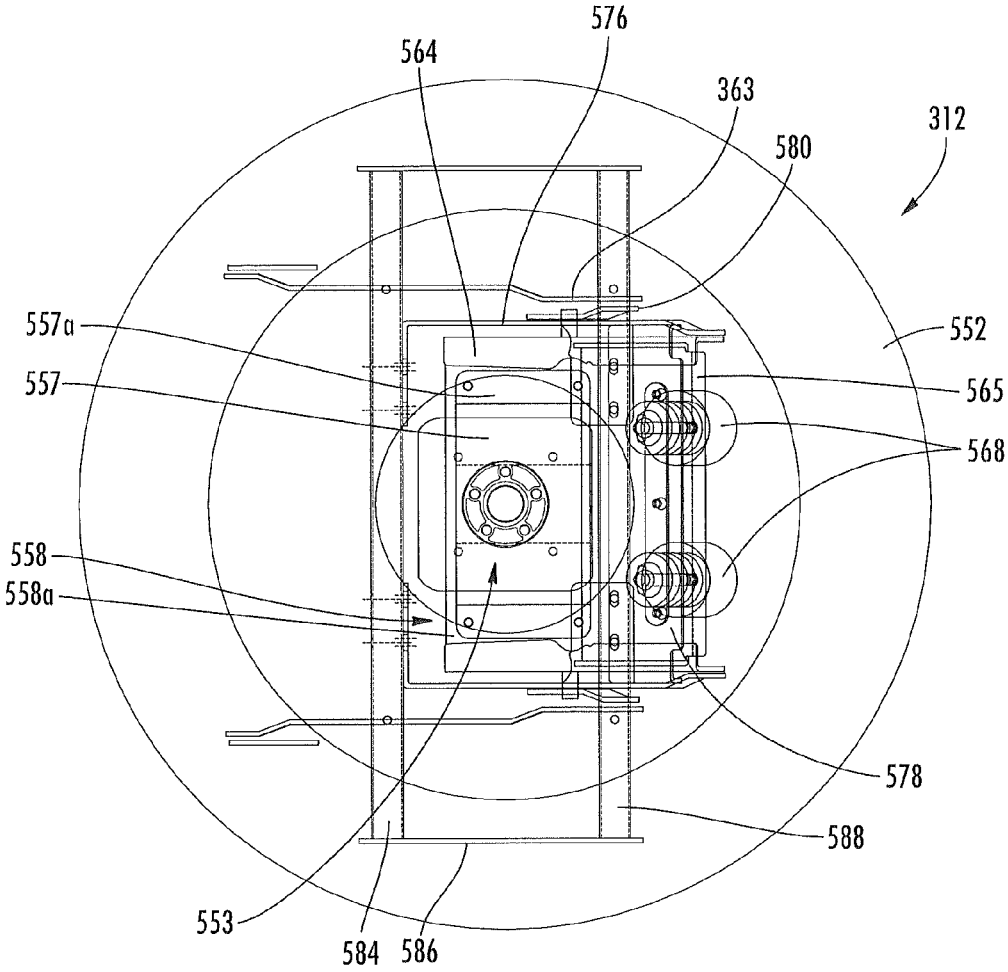
FIG. 15 is a top view of the rocking assembly of the chair of FIG. 9.

Referring now to FIG. 15, the base 312 includes a flat, circular, two-level foundation 552 that rests on the floor or other underlying surface and a swivel unit 553 that is mounted on the foundation 552. The swivel unit 553 includes a sleeve 554 within which is mounted a rotatable spindle 556. An upper plate 557 with lateral flanges 557*a* is mounted to the spindle 556. A lower mounting structure 558 is mounted to the spindle 556 below the upper plate 557; the flanges 557*a* are fixed to the flat surface 558*a* of the mounting structure 558 to form a rigid assembly.

The rocker assembly 313 includes bracket projections 564 that extend from each lateral end of the mounting structure 558. A cross-member 565 extends between the bracket projections 564. A rocking link 576 is mounted at a pivot 579 to each bracket projection 564. The pivot 579 is positioned well forward of the spindle 556 of the swivel unit 553, typically between about 3 and 7.5 inches from the front of the seat 316. A spring base 578 spans the front portions of the rocking links 576. A cross-member 584 spans the rear portions of the rocking links 576, and a cross-member 588 is mounted to lower forward portions of the rocking links 576. Pins 564*a* mounted to the bracket projections 564 extend through respective arcuate slots 576*a* in the rocking links 576.

Each of two spring units 568 includes a helical spring 570 and a spring rod 572. The spring rod 572, which passes through the coils of the spring 570, is mounted at one end to a cap 575, which is threaded onto the spring rod 572, and at its other end to the cross-member 565 at a pivot 574. A stop plate 580 is mounted to each of the rocking links 576 at a pivot 582. A slot 580*a* in each of the stop plates 580 receives a respective pin 564*a*.

Figure 9:
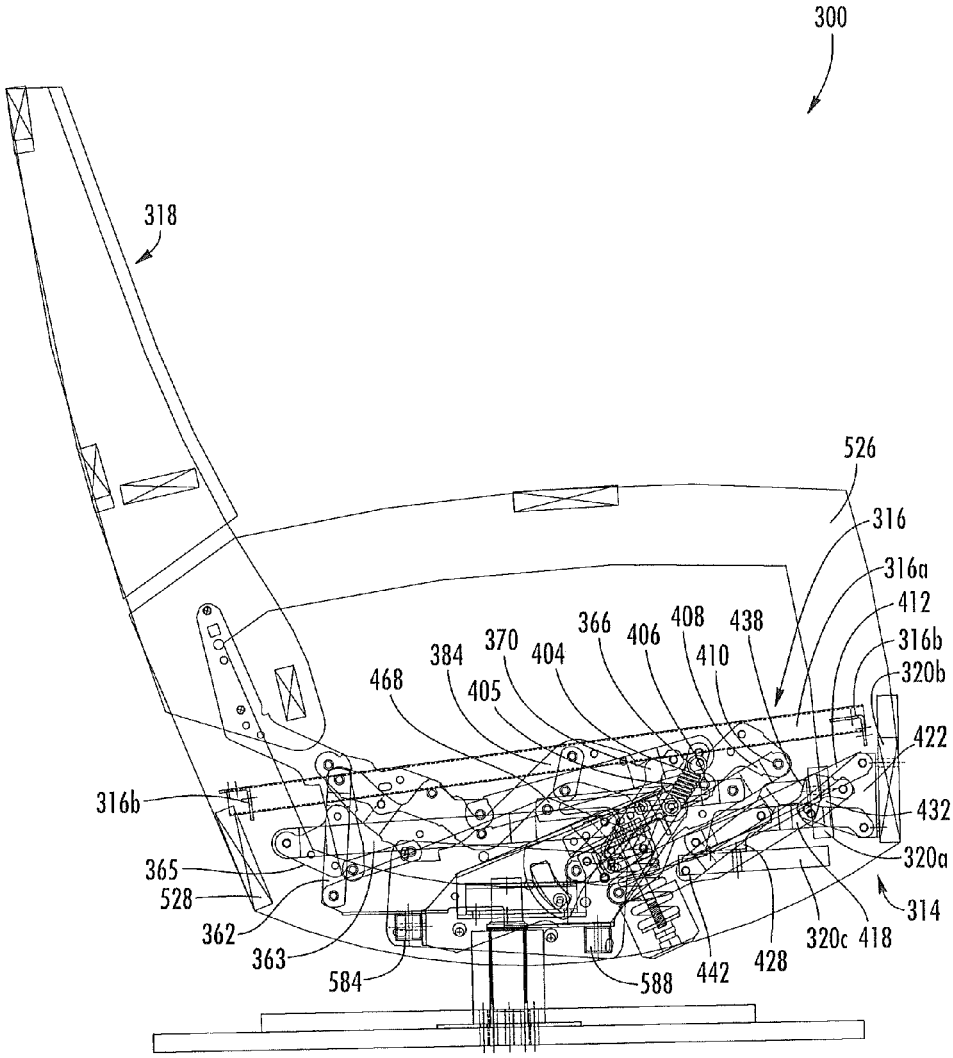
FIG. 9 is a side section view of a rocker-recliner chair according to additional embodiments of the present invention, with the chair shown in its upright position.

Referring now to FIG. 9, the arm frame 314 includes two arms 526. The arms 526 are spanned by a cross-member 228, and by the cross-members 584, 588, which are mounted to the inner surfaces of the arms 526 via mounting panels 586.

Still referring to FIG. 9, the seat 316 includes side rails 316*a* and cross-members 316*b*, which combine to form a generally square structure. A cushion (not shown) rests on the side rails 316*a* and cross-members 316*b*. A seat panel 384 is mounted to the outside of each side rail 16*a*.

Turning now to the reclining mechanism 321, each of the reclining mechanisms 321 is a mirror image of the other reclining mechanism about a vertical plane that extends from the front of the chair 300 to the rear centered between the arms 526. In the interest of brevity, only one reclining mechanism 321 will be described herein, with the understanding that the discussion is equally applicable to the other reclining mechanism 321. Also, the reclining mechanism 321 will be described first with respect to the fully reclined position (FIG. 11) in order to illustrate more easily the interconnection of the various links thereof.

Figure 11:
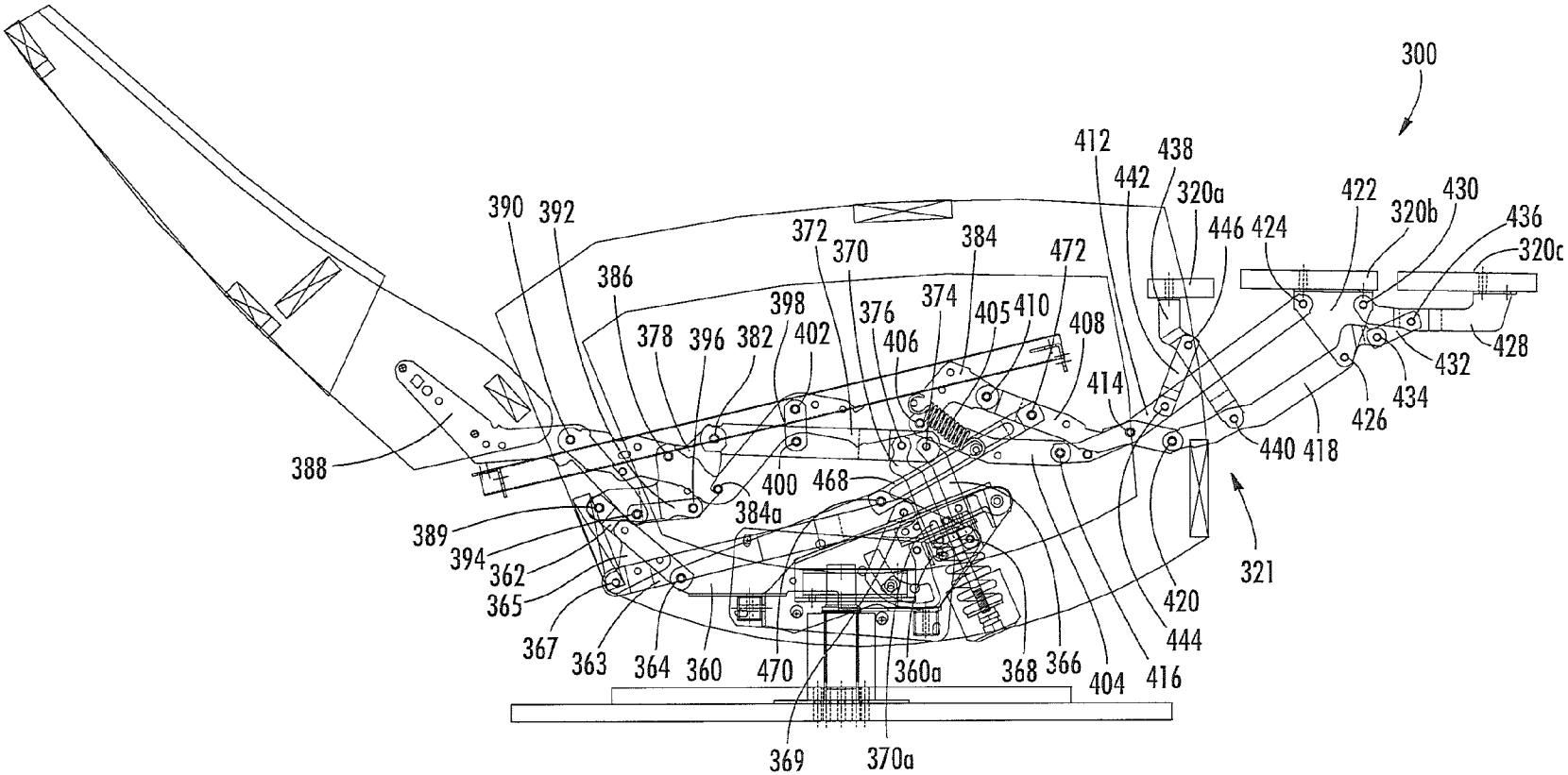
FIG. 11 is a side section view of the chair of FIG. 9 shown in its fully reclined position.
Figure 12:
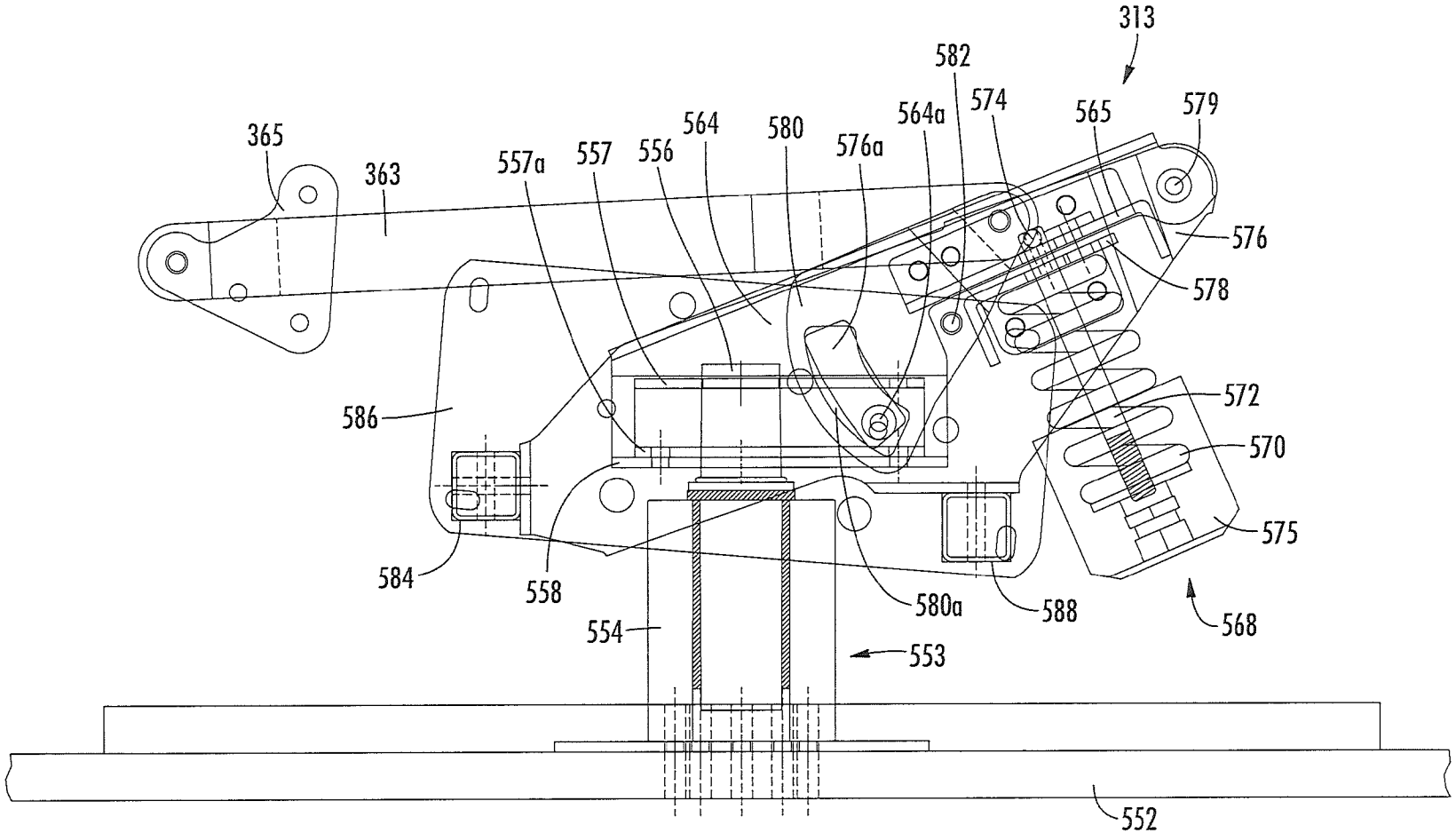
FIG. 12 is a side view of the rocking assembly of the chair of FIG. 9 shown rocked forwardly.
Figure 13:
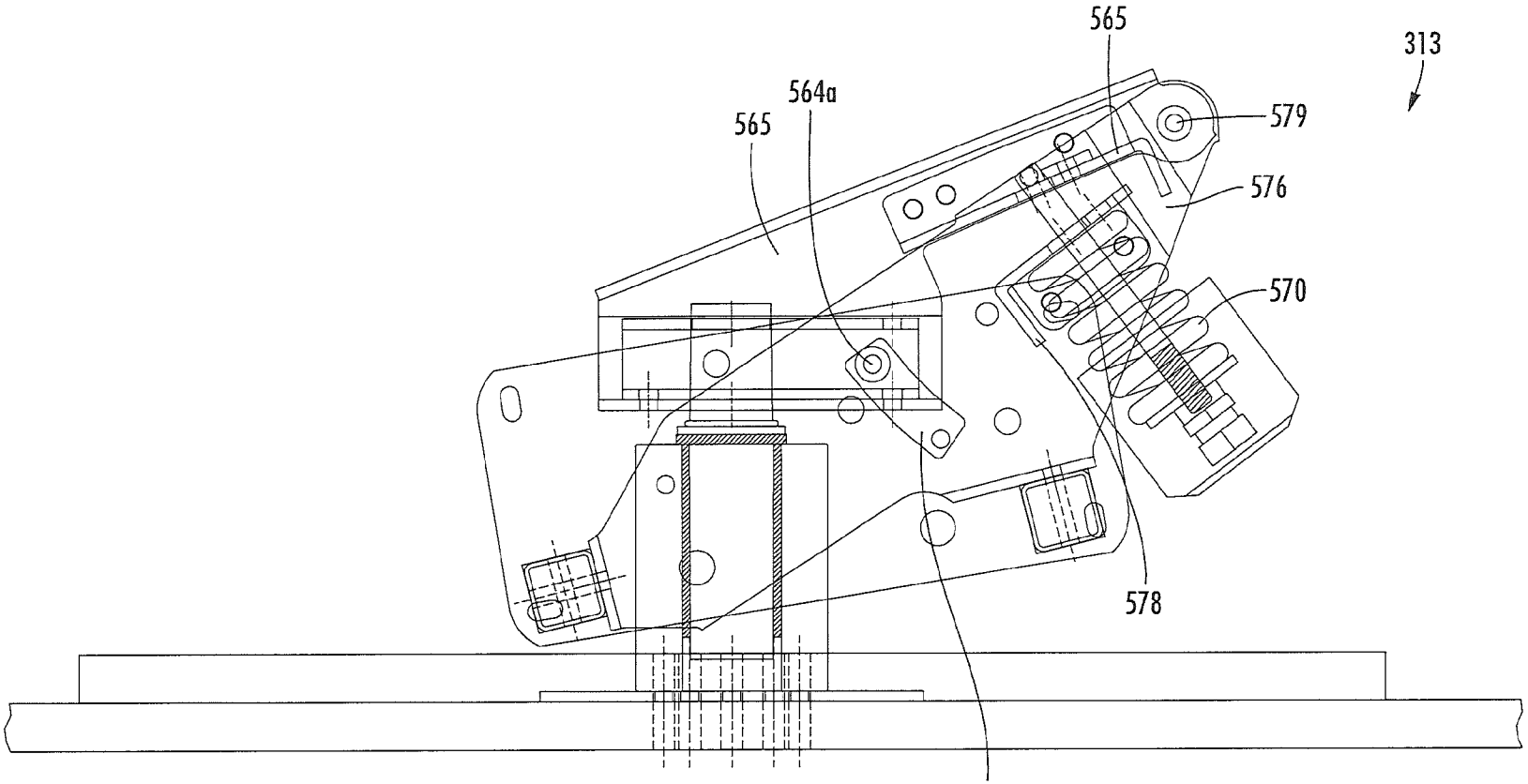
FIG. 13 is a side view of the rocking assembly of FIG. 12 shown rocked rearwardly.
Figure 14:
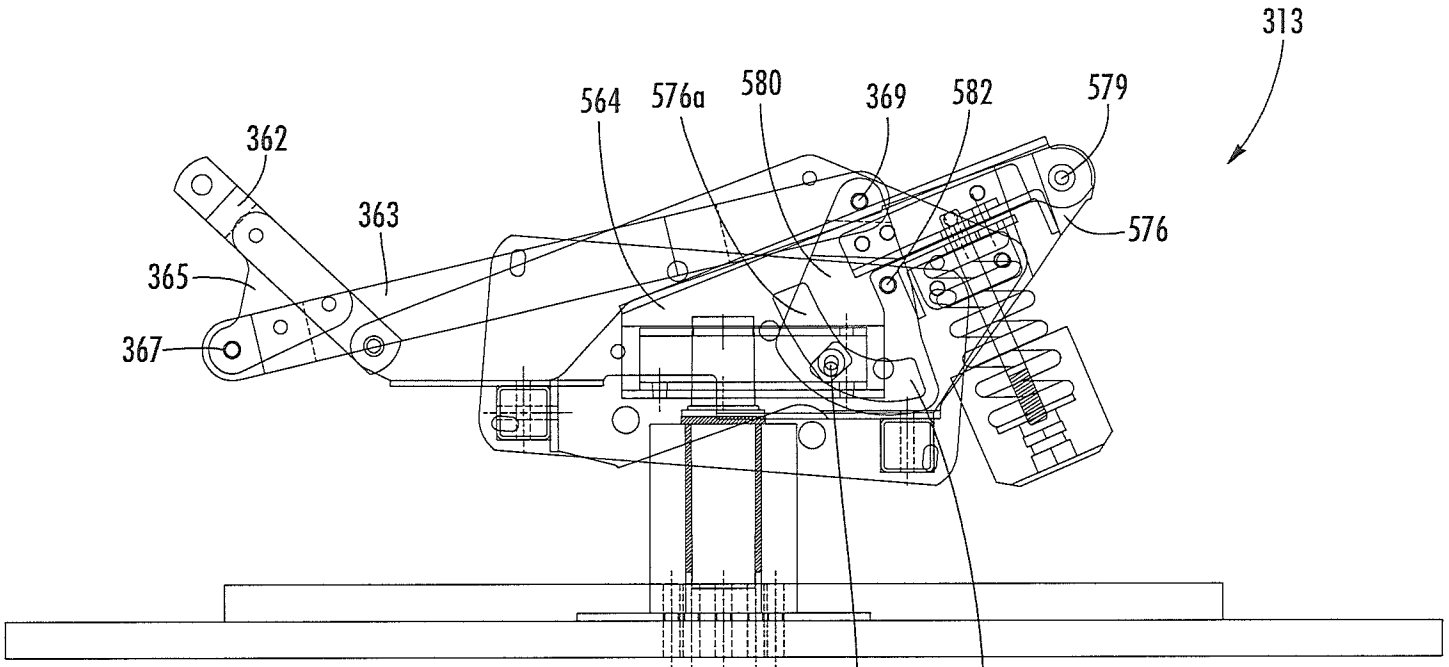
FIG. 14 is a side view of the rocking assembly of FIG. 12 shown with the chair in its TV or fully reclined positions, such that the rocking assembly is prevented from rocking.

Referring still to FIG. 11, the reclining mechanism 321 has an angled frame bracket 360 mounted to the upper surfaces of the cross-members 582, 588. A rear swing link 362 is attached at its lower end to the frame bracket 360 at a pivot 364 and extends upwardly and rearwardly therefrom. A projection 365 is fixed to the rear swing link 362 and extends reardwardly therefrom. A connecting link 363 is attached to the projection 365 at a pivot 367 and to the upper end of the stop plate 580 at a pivot 369.

A front swing link 366 is attached at its lower end to the frame bracket 360 at a pivot 368 and extends upwardly and slightly rearwardly therefrom. A sequencer link 370 is attached to the frame bracket 360 via slot 370*a* that receives a pin 360*a* on the frame bracket 360. The sequencer link 370 extends upwardly and rearwardly to attach to a connector link 372 at a pivot 376; the front swing link 366 also attaches to the connector link 372 at a pivot 374. The connector link 372 extends substantially rearwardly from the pivot 376 to a pivot 382 with a transition plate 378. The transition plate 378, which has three fingers, is attached by its middle finger to the seat panel 384 at a pivot 386, and is also attached at its rear finger with the upper end of the rear swing link 362 at a pivot 389. A control link 398 is attached to the seat panel 384 at a pivot 402 and to the connector link 372 at a pivot 400.

Still referring to FIG. 11, a tripartite backpost 388 is fixed to the backrest 318 and extends downwardly and forwardly therefrom. At one of its interior vertices, the backpost 388 is attached to the seat panel 384 at a pivot 390. A drive link 392 is attached to the lower, forward end of the backpost 388 at a pivot 394 and extends forwardly therefrom to a pivot 396 with the lower portion of the transition plate 378.

Referring still to FIG. 11, a rear ottoman drive link 404 is attached at a pivot 406 to the seat panel 384 and extends forwardly therefrom. A spring 405 extends between the rear ottoman drive link 404 and the seat panel 384. A front ottoman drive link 408 is attached at a pivot 410 to the seat panel 384 at a pivot that is positioned forwardly and upwardly from the pivot 406. A rear ottoman extension link 412 is attached to the forward end of the rear ottoman drive link 404 at a pivot 416 and extends forwardly and upwardly therefrom; the rear ottoman extension link 412 is also attached to an intermediate section of the front ottoman drive link 408 at a pivot 414. A front ottoman extension link 418 is attached at its rear end to the front end of the front ottoman drive link 408 at a pivot 420 and extends forwardly and upwardly therefrom generally parallel with the rear ottoman drive link 412. A main ottoman bracket 422, to which the main ottoman 320*b* is mounted, is attached to the forward ends of the rear ottoman drive link 412 and the front ottoman drive link 418 at, respectively, pivots 424 and 426.

Referring once again to FIG. 11, a front ottoman bracket 428 is attached to the main ottoman bracket 422 at a pivot 430 and extends forwardly therefrom. The front ottoman 320*c* is mounted to the forward end of the front ottoman bracket 428. A control link 432 extends between a pivot 434 with the front ottoman extension link 418 and a pivot 436 with the front ottoman bracket 428. A rear ottoman bracket 438 is attached to the front ottoman extension link 418 at a pivot 440 and extends upwardly and rearwardly to support the rear ottoman 320*a* mounted thereon. A bracing link 442 extends between a pivot 444 with the rear ottoman extension link 412 and a pivot 446 with the rear ottoman bracket 438.

A drive link 468 is attached to the front ottoman drive link 408 at a pivot 472, and extends rearwardly therefrom to a pivot 470 with the frame mounting bracket 360.

Operation of the chair typically begins in the upright position (FIG. 9). In the upright position, the ottomans 320*a*, 320*b*, 320*c* are all folded beneath the seat 316, with the main ottoman 320*b* positioned below the front of the seat 316 and vertically disposed, the rear ottoman 320*a* behind the main ottoman and vertically disposed, and the front ottoman 320*c* horizontally disposed and facing the underlying surface. The links comprising the portion of the reclining mechanism 321 that extends the ottoman (i.e., the front and rear ottoman drive links 408, 404, the front and rear ottoman extension links 418, 412, the front, main and rear ottoman brackets 428, 422, 438, the control link 432, and the bracing link 442) are folded beneath the seat 316 as a pantographic linkage. The seat 316 is disposed above the base 312 and typically has a pitch angle of between about 5 and 8 degrees relative to horizontal, and the backrest 318 has a first backrest angle $\alpha$ of between about 60 and 80 degrees relative to horizontal. The reclining mechanism 321 is maintained in place by tension in the spring 405, which urges the reclining mechanism 321 toward the upright position.

In the upright position, the rocking assembly 562 enables the seat 316, backrest 318, arm frame 314, and ottomans 320*a*, 320*b*, 320*c* to rock relative to the base 312. When the chair 300 is in the upright position, the seat 316, backrest 318, arm frame 314, and ottomans 320*a*, 320*b*, 320*c* are fixed relative to the rocking link 576. The rocking link 576 pivots relative to the projection 564 about the pivot 579, with that motion being dampened by the spring 570. The range of motion is limited by the action of the pin 564*a* within the slots 576*a* and 565*a*, which are generally aligned with each other (see FIGS. 12 and 13).

Figure 10:
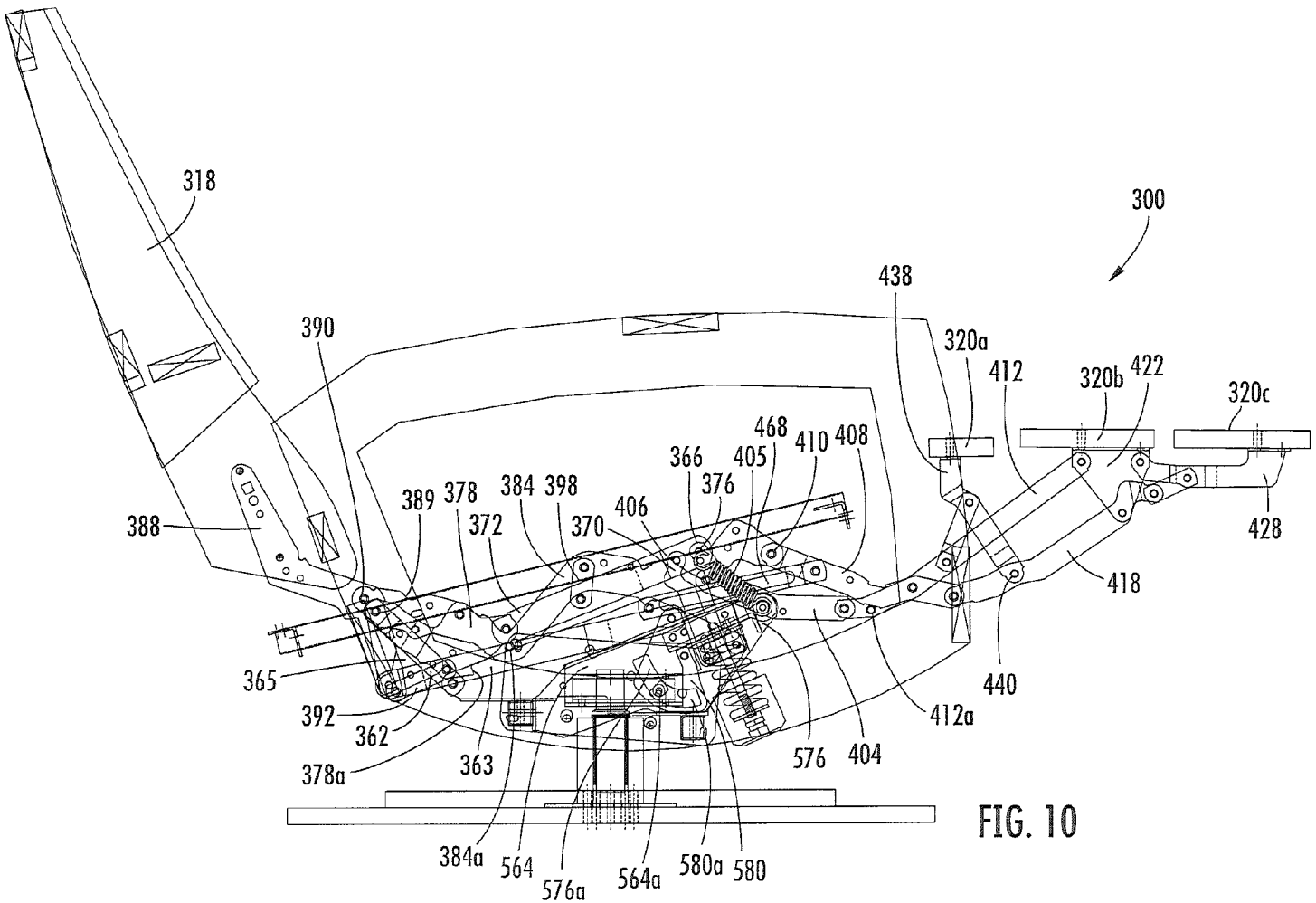
FIG. 10 is a side section view of the chair of FIG. 9 shown in its TV position.

To move the chair 10 from the upright position of FIG. 9 to the TV position of FIG. 10, the occupant of the chair 300 pushes forwardly on the arms 526, which action forces the occupant's back rearwardly into the backrest 318. Forcing the backrest 318 and seat 316 rearwardly relative to the base 312 draws the seat 316 and seat panel 384 rearwardly; this movement is largely controlled by the rear swing link 362, the front swing link 366, and the sequencer link 370. As the seat 316 moves rearwardly, the drive link 468 rotates only slightly, with the net effect that the front ottoman drive link 408 rotates counterclockwise considerably about the pivot 410. This action also extends the front and rear ottoman extension links 418, 412, which in turn rotates the rear ottoman link 404 counterclockwise about the pivot 406. Once rotation of the rear ottoman drive link 404 causes the axis defined by the spring 405 to pass the pivot 406, the spring 405 then urges the rear ottoman drive link 404 toward the TV position. Relative separation of the front and rear ottoman extension links 418, 412 also rotates the main ottoman bracket 422 and the main ottoman 320*b* to a generally horizontal disposition in front of the seat 416. Extension of the front ottoman extension link 418 and rotation of the main ottoman bracket 422 also draws forward and inverts the front ottoman bracket 428 and the front ottoman 320*c*. Extension and separation of the front and rear ottoman extension links 418, 412 also forces the rear ottoman bracket 438 and the rear ottoman 320*a* upwardly and rotates the rear ottoman bracket about the pivot 440. Extension of the ottomans 320*a*, 320*b*, 320*c* ceases when the lower edge of the front ottoman drive link 408 strikes a stop pin 412*a* on the rear ottoman extension link 412.

In addition, the counterclockwise rotation of the rear swing link 362 draws the connecting link 363 rearwardly. This has the effect of rotating the stop plate 580 counterclockwise about the pivot 582. Rotation of the stop plate 580 moves the rear end of the slot 580*a* toward the front end of the slot 576*a*, such that the pin 564*a* is captured by the rear end of the slot 580*a* and the front end of the slot 576*a*. Capture of the pin 564*a* prevents the rocking link 576 from rocking relative to the mounting projections 565, thereby preventing rocking motion of the chair 300 when it is in the TV position (see FIG. 14).

To move the chair 300 to the fully reclined position of FIG. 11, the occupant again pushes forwardly on the arms 526, which forces the occupant's back into the backrest 318. This action forces the backpost 388 and the backrest 318 to rotate counterclockwise about the pivot 390 and move to a reclined position relative to the seat 316. Rotation of the backpost 388 drives the drive link 392 forwardly, which in turn causes the transition plate 378 to rotate counterclockwise about the pivot 389. Rotation of the transition plate 378 drives the seat panel 384 upwardly. As the seat panel 384 rises, through the control link 398 it pulls the connecting link 372 upwardly and rotates it clockwise about the pivot 376. Rotation ceases when an edge 378*a* of the transition plate 378 contacts a pin 384*a* on the seat panel 384. In this position, the backrest 318 typically reclines at a second backrest angle α' of between about 45 and 65 degrees relative to horizontal.

Also, in this position the arm frame 314, the backrest 318, the seat 316 and the ottomans 320*a*, 320*b*, 320*c* are prevented from rocking by the capture of the pins 564*a* by the stop plate 580 and the projection 364.

The chair 300 can be returned to the TV and/or upright position by the occupant pushing downwardly with his feet on one or more of the ottomans 320*a*, 320*b*, 320*c* and/or the occupant pulling forward on the arms. The links of the reclining mechanism 321 will reverse the various movements described above.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A reclining seating unit, comprising:

a base;

a rocker assembly fixed to the base;

an arm frame fixed to the rocker assembly;

wherein the rocker assembly is configured such that the arm frame experiences rocking motion relative to the base;

a generally horizontally-disposed seat;

a generally upright backrest positioned rearwardly of the seat;

a footrest unit;

a reclining mechanism that interconnects and controls movement of the seat and the backrest relative to the arm frame between an upright position and a reclined position;

wherein in the upright position, the backrest is generally upright and positioned above the arm frame, and the seat has a first rearward position relative to the arm frame; and wherein in the reclined position, the backrest is reclined relative to the underlying surface as compared to its disposition in the upright position and the seat has a second forward position relative to the arm frame that is forward of the first rearward position;

the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat; the footrest mechanism being decoupled from the reclining mechanism;

wherein, when the backrest moves between the upright and reclined positions, the footrest unit moves relative to the arm frame in concert with the seat; and wherein, in the reclined position, the rocker assembly is configured such that the arm frame is prevented from rocking.

2. The reclining seating unit defined in claim 1, wherein the rocking mechanism is coupled to the reclining mechanism.

3. The reclining seating unit defined in claim 1, wherein the reclining mechanism is configured to move the seating unit to an intermediate TV position.

4. The reclining seating unit defined in claim 3, wherein the rocking mechanism is configured such that arm frame is prevented from rocking when the seating unit is in the TV position.

5. The reclining seating unit defined in claim 1, wherein the at least one footrest is three footrests.

6. The reclining seating unit defined in claim 1, wherein the footrest mechanism includes a spring that biases the footrest mechanism toward the retracted position when the footrest mechanism is in the retracted position.

7. The reclining seating unit defined in claim 1, wherein the seating unit is a chair.

8. The reclining seating unit defined in claim 1, wherein the rocker assembly comprises: a mounting bracket fixed to the base; a rocking link fixed to the arm frame and pivotally attached to the mounting bracket; and a spring unit attached to the mounting bracket and to the rocking link that is configured to dampen relative rocking motion of the arm frame and the base.

9. The reclining seating unit defined in claim 1, wherein the rocking assembly is configured such that during the rocking motion a frontmost portion of the seat experiences little to no vertical movement.

10. A reclining seating unit, comprising:

a base;

a rocker assembly fixed to the base;

an arm frame fixed to the rocker assembly;

a generally horizontally-disposed seat;

a generally upright backrest positioned rearwardly of the seat;

a reclining mechanism that interconnects and controls movement of the seat and the backrest relative to the arm frame between an upright position and a reclined position;

wherein in the upright position, the backrest is generally upright and positioned above the arm frame, and the seat has a first rearward position relative to the arm frame; and wherein in the reclined position, the backrest is reclined relative to the underlying surface as compared to its disposition in the upright position;

wherein the rocker assembly is configured such that the arm frame experiences rocking motion relative to the base and comprises:

a mounting bracket fixed relative to the base;

a rocking link fixed relative to the arm frame and pivotally attached to the mounting bracket at a first pivot, wherein the first pivot is positioned near a frontmost portion of the seat; and a spring unit attached to the mounting bracket and to the locking link that is configured to dampen relative rocking motion of the arm frame and the base; and wherein, in the reclined position, the rocker assembly is configured such that the arm frame is prevented from rocking;

and wherein the spring unit comprises:

a helical spring;

a rod that is inserted within coils of the spring, wherein a first end of the rod is pivotally attached to the mounting bracket;

an end cap attached to a second end of the rod and abutting one end of the spring; and a spring base fixed to the rocking link and abutting the other end of the spring.

11. The seating unit defined in claim 10, wherein the first pivot is positioned such that the frontmost end of the seat experiences little to no upward movement during rocking motion of the arm frame.

12. The seating unit defined in claim 10, wherein the first pivot is positioned such that the seat moves between a first unrocked position, in which a rearwardmost end of the seat is in a relatively rearward and raised position, and a second rocked position, in which the rearwardmost end of the seat is in a forward and lowered position compared to the unrocked position.

13. The seating unit defined in claim 10, wherein the mounting bracket includes one of a slot and a pin, and wherein the rocking link includes the other of a slot and a pin, wherein the pin is received in the slot, and wherein the rocking motion is controlled by movement of the pin within the slot.

14. The seating unit defined in claim 13, wherein the rocker assembly is coupled with the reclining mechanism.

15. The seating unit defined in claim 14, wherein the mounting bracket includes the pin and the rocking link includes the slot and wherein the rocker assembly further includes a stop plate having a slot that receives the pin of the mounting bracket, and wherein in the reclined position the pin is captured by the slot of the rocking link and the slot of the stop plate.

16. The seating unit defined in claim 15, wherein each of the slots is arcuate and is oriented with one end located rearwardly and upwardly from another end.

17. The seating unit defined in claim 10, wherein the spring unit is configured such that compression levels in the spring unit are adjustable.

18. The seating unit defined in claim 10, further comprising a footrest unit, the footrest unit comprising at least one footrest and a footrest mechanism that interconnects the footrest with the seat, the footrest mechanism configured to move the footrest between a retracted position, in which the footrest is positioned beneath the seat, and an extended position, in which the footrest is generally horizontally disposed in front of the seat; the footrest mechanism being decoupled from the reclining mechanism; and wherein when the backrest moves between the upright and reclined positions, the footrest unit moves relative to the arm frame in concert with the seat.

19. A reclining seating unit, comprising:

a base;

a rocker assembly fixed to the base;

an arm frame fixed to the rocker assembly;

a generally horizontally-disposed seat;

a generally upright backrest positioned rearwardly of the seat;

a reclining mechanism that interconnects and controls movement of the seat and the backrest relative to the arm frame between an upright position and a reclined position;

wherein in the upright position, the backrest is generally upright and positioned above the arm frame, and the seat has a first rearward position relative to the arm frame; and wherein in the reclined position, the backrest is reclined relative to the underlying surface as compared to its disposition in the upright position;

wherein the rocker assembly is configured such that the arm frame experiences rocking motion relative to the base and comprises:

a mounting bracket fixed relative to the base;

a rocking link fixed relative to the arm frame and pivotally attached to the mounting bracket at a first pivot, wherein the first pivot is positioned near a frontmost portion of the seat; and a spring unit attached to the mounting bracket and to the locking link that is configured to dampen relative rocking motion of the arm frame and the base; and wherein, in the reclined position, the rocker assembly is configured such that the arm frame is prevented from rocking;

wherein the mounting bracket includes a pin, and wherein the rocking link includes a slot, wherein the pin is received in the slot, and wherein the rocking motion is controlled by movement of the pin within the slot;

wherein the rocker assembly is coupled with the reclining mechanism; and wherein the rocker assembly further includes a stop plate having a slot that receives the pin of the mounting bracket, and wherein in the reclined position the pin is captured by the slot of the rocking link and the slot of the stop plate.

* * * * *